US007008029B1

(12) United States Patent
Aclin

(10) Patent No.: US 7,008,029 B1
(45) Date of Patent: Mar. 7, 2006

(54) WALL SUSPENDED JEWELRY CASE

(76) Inventor: Faith E. Aclin, 8811 Cherokee St., Youngstown, FL (US) 32466

( * ) Notice: Subject to any disclaimer, the term of this patent is extended or adjusted under 35 U.S.C. 154(b) by 0 days.

(21) Appl. No.: 11/179,001

(22) Filed: Jul. 11, 2005

Related U.S. Application Data

(60) Provisional application No. 60/587,139, filed on Jul. 13, 2004.

(51) Int. Cl.
*A47B 67/02* (2006.01)
*A45C 11/04* (2006.01)

(52) U.S. Cl. ..... 312/245; 206/6.1; 206/566; 312/227

(58) Field of Classification Search ..... 206/6.1, 206/566; 211/85.2; 220/476, 478, 480; 312/245–247, 291, 224, 227, 293.2
See application file for complete search history.

(56) References Cited

U.S. PATENT DOCUMENTS 4,043,450 A * 8/1977 Rielly ..... 206/6.1
4,099,611 A * 7/1978 Feibelman ..... 206/6.1
4,324,446 A * 4/1982 LeSage ..... 312/245
4,413,736 A * 11/1983 Nibling ..... 206/566
4,420,084 A * 12/1983 Whelan ..... 206/566
4,739,878 A * 4/1988 DiDomenico ..... 206/6.1
4,767,011 A * 8/1988 Butler ..... 211/85.2
5,141,300 A * 8/1992 Ciesla ..... 312/245
5,172,814 A 12/1992 Pell et al.
5,511,873 A 4/1996 Mech
5,758,936 A 6/1998 Baughan
6,361,130 B1 3/2002 Kardy
6,375,018 B1 4/2002 Clement

* cited by examiner

*Primary Examiner*—Luan K. Bui
(74) *Attorney, Agent, or Firm*—William B. Noll

(57) ABSTRACT

Invention discloses a wall suspendible cabinet for storing and displaying jewelry items, especially of the type for storing and displaying earrings having a looped hook, or a post and lock. The cabinet comprises a first section and at least a second section hinged thereto, pivotal from an open or jewelry displayed mode, to a closed or storage mode. The respective sections, along the inside faces thereof, includes means for suspending such jewelry items. One such means comprises a pleated mesh having a mesh face lying against a section backing face, and a series of laterally oriented, meshed flaps extending from the mesh face.

7 Claims, 4 Drawing Sheets

WALL SUSPENDED JEWELRY CASE

RELATED APPLICATION

This application is related to and claims priority of Provisional Application, Ser. No. 60/587,139, filed Jul. 13, 2004, under the title, Wall Suspended Jewelry Case, by the inventor hereof, where the contents are incorporated herein in their entirety.

FIELD OF THE INVENTION

This invention is directed to the field of wall mounted storage cabinets, more particularly to a wall suspended case for receiving and storing jewelry, where the suspended case includes at least a pair of hinged sections.

BACKGROUND OF THE INVENTION

The present invention relates to a wall suspended, pivotal jewelry case that appears as a framed picture, painting or portrait in a closed position, while in the pivoted position reveals a plurality of necklace and bracelet mounting hooks, and a series of free hanging mesh strips for easily mounting and retrieving earrings of the type having either a looped hook or a post and lock, the type of earrings to be worn in pierced ear lobes, etc.

As it is well known, jewelry is one of the most prevalent fashion accessories. As a consequence, many women have numerous pieces of jewelry. In selecting jewelry to complement clothing, or to make an individual fashion statement, a wearer may seek to form a certain particular combination of earrings, necklaces, bracelets, etc. Also the determination of whether a certain combination is desirable may be formed only after wearing the individual pieces and viewing the appearance of the combination.

The selection and viewing of a jewelry combination can be a very frustrating experience. All the different items of jewelry usually are stored in different places. The mixing of the items of jewelry may require the retrieving of a large number of storage containers such as jewelry cases. Also the viewing of the result of a certain selection of jewelry may be burdensome. Jewelry case mirrors may be too small. Using a dresser mirror may require the placing of the jewelry storage containers within easy reach.

Also, jewelry cases may be suitable for organizing and storage of a particular kind of jewelry, such as earrings, but ill suited for the storage and/or display of other items such as necklaces. For example, drawer storage may be appropriate for earrings and rings but necklaces, particularly those with fine chains, may become snarled in a drawer.

Earrings in particular pose a storage and display problem, as they come in many different styles, such as post, wire, clip or hoop. Each style is sufficiently different that storage and display cases which are uniquely configured for one style of earring may be unsuitable to store and display the other styles.

Wearers of jewelry have found out that the placement of such items as chains, necklaces, earrings, pendants, charms, etc., when placed in a common drawer or jewelry box, usually become mixed up and tangled, providing a particular problem in the ability to readily locate particular items of jewelry when they are desired to be worn. Currently, in this arrangement they become easily knotted or tangled and damage frequently results during the untangling process.

Over and above the concerns with storage and tangled masses of chains, etc., there are the concerns that are always present regarding theft. Absent a wall or floor mounted safe, where jewelry may logically be stored, where very few have the luxury of such safes, the vast majority of people, such as a college coed, have to rely on such traditional methods as hiding the jewelry in a dresser drawer. Unfortunately, thieves can easily locate these traditional hiding places. Thus, jewelry organization, now coupled to safety, are concerns people have, especially women.

The prior art is replete with references that attempt to address these concerns, where such prior art is exemplified by the following U.S. patents:

a.) U.S. Pat. No. 6,375,018, to Clement, discloses an apparatus for the storage and display of articles of jewelry having a plurality of plastic strips that are disposed in parallel alignment with respect to each other and which each include a pair of spaced apart openings on each end thereof that are adapted for placement over a pair of posts. The pair of posts are disposed in a parallel spaced apart relationship with respect to each other. Each of the plastic strips includes a plurality of fingers that protrude slightly outward and away from the posts and are adapted to receive and to retain an article of jewelry that may be suspended therefrom. The posts are retained in position in a cabinet. The strips are retained in position along the pair of posts unless the strips are acted on by a force which tends to urge them in either direction along the longitudinal length of the pair of posts. The strips may be urged either close together or further apart to accommodate various sizes of jewelry items. A brace is preferably used to retain the pair of posts in a proper spaced-apart relationship. The cabinet includes a door that is hingedly attached to a rear half and, when closed, is used to protect the jewelry from the elements and also to conceal the jewelry and, if desired, for purposes of transport.

b.) U.S. Pat. No. 6,361,130, to Kardy, teaches a storage cabinet, comprising a first frame for mounting on a wall structure; a second frame hinged for movement with respect to the first frame; a plurality of transverse members arranged in the first and second frames; a plurality of hooks, pins or the like, mounted to the transverse members for supporting a stored item, such as jewelry; a separation membrane hinged for movement with respect to the first and second frames for segregating the stored item supported by the supporting member of the first frame from the stored item supported by the supporting member of the second frame; and a cover member mounted on the second frame. The separation membrane may be a transparent member, such as a flexible plastic sheet, for facilitating visual observation of the stored item. The first and second frames may each have a narrow profile sized for mounting on a wall of a building structure in the space formed between the wall and a fully-opened door of the building structure without substantially interfering with the movement of the door.

c.) U.S. Pat. No. 5,758,936, to Baugham, relates to a jewelry security cabinet for the storage and display of objects, specifically necklaces, pendants, rings and earrings. It includes a front cover structure and a rear box-type structure. The mounting surface of the rear box-type structure is constructed to hang on a wall or be set recessed into a wall. The outside surface of the front cover structure is constructed to appear like a picture or a mirror. The front cover structure may be larger than the rear box-type structure to enhance the invisibility aspect. The front cover structure and the rear box-type structure are hingedly connected and have a closure for securing the jewelry security cabinet. The inner surfaces have pins and hangers so as to hold selected objects. Within the rear box-type structure are two detachable display cases. One of the cases is hingedly attached, such that it is swingable and easily removable and holds, for example, earrings. The other case may be a slotted ring holder.

d.) U.S. Pat. No. 5,511,873, to Mech, covers a jewelry cabinet having a generally rectangular housing with a peripheral wall and a rear planar wall and a generally vertically extending middle wall which forms a left compartment and a right compartment within the housing. A left door and right door are pivotally connected to the housing and adapted to close the left compartment and right compartment respectively. A portion of the exterior of one of the doors is mirrored. On the interior of at least of the left and right doors is arranged a plurality of hanging hooks to retain necklaces.

e.) U.S. Pat. No. 5,172,814, to Pell et al., is directed to a board for holding and displaying jewelry consisting of a base and a plurality of removable and replaceable jewelry holding bracelets adapted to support on an individual basis clip type earrings, earrings for pierced ears, bracelets, necklaces, finger rings and pins. A special holder for supporting hair barrettes, such as used by little girls, is also adapted to be included or utilized with the board. The particular number of each type of support unit and their arrangement thereon can be determined by the user. Each of the elements for holding jewelry with the exception of an included pin pad and a shelf for supporting finger rings, can be removed and replaced on an as-desired basis.

While the foregoing prior art offer some security and convenience to the user thereof, especially women who wish to store jewelry items, none present a system to store and easily mount and retrieve pairs of earrings, such as those used by women with pierced ears. The manner by which this invention meets the needs of women will become more apparent in the description and drawings which follow.

SUMMARY OF THE INVENTION

This invention relates to a foldable or pivotal jewelry case adapted to be suspended or hung from a wall, where the jewelry case when pivoted to a closed position reveals a conventional picture or mirror frame, but when opened provides a convenient system for storing and mounting various items, particularly earrings. The jewelry case comprises a first, generally rectangular housing section to receive a set or type of jewelry items, and at least a second, generally rectangular housing section hinged for pivotal movement thereon. In a preferred embodiment, the hinges are internal or hidden such that the respective housing sections show no visible signs of a hinged connection. This feature has particular utility as a safety device to deter thievery from unsuspecting intruders who would probably search elsewhere for one's jewelry. In any case, at least one said housing section includes a peripheral side wall and a planar rear wall mounting plural, free hanging, mesh-like strips secured along an upper edge to said planar rear wall. By this arrangement, manual access is available to the undersides of the strips. This is important in removably mounting plural pairs of earrings that are characterized by a decorative face having a post extending generally perpendicular thereto, where the post may be secured, such as by a sliding lock member. That is, the readily accessible back side of the strip allows for the securing or removal of the selected earring. The other or remaining housing sections, also characterized by a peripheral frame and planar face member, may mount a plurality of hooks from which a variety of jewelry items may be suspended without tangling with other such items.

Accordingly, a feature of this invention is the provision of a wall mounted jewelry case having the appearance of a conventional picture/mirror when suspended on a wall, yet providing a convenient storage space for a variety of jewelry items, particularly easily accessible earrings.

Another feature of the invention are plural pivotal housing sections, where at least one said housing section includes a peripheral side housing wall and a planar face member mounting plural, free hanging, mesh-like strips that include readily accessible rear sides for securing the sliding locking member of a post-like earring.

These and other features of the invention will become more apparent in the description which follows, particularly when read in conjunction with the accompanying drawings.

DETAILED DESCRIPTION OF PREFERRED EMBODIMENT

Figure 1:
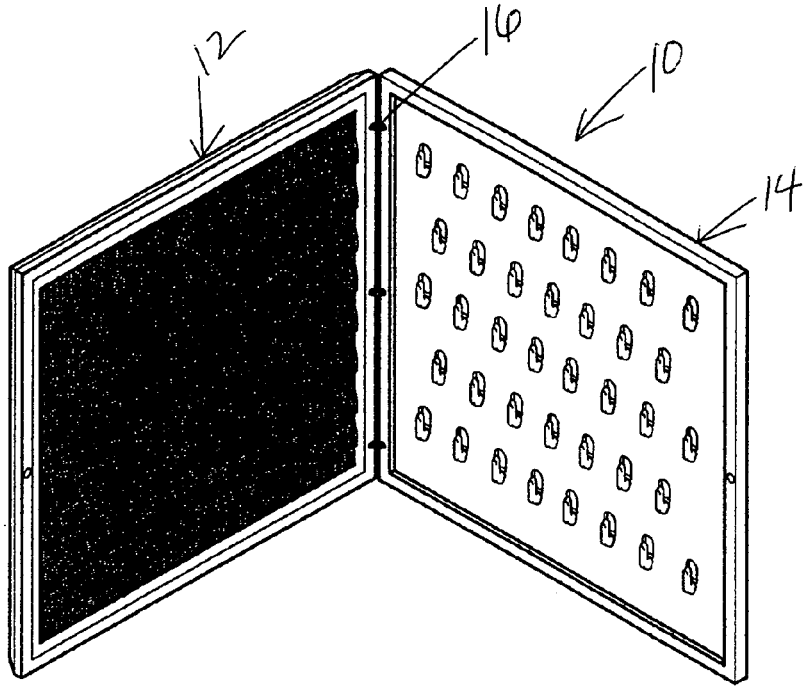
FIG. 1 is a perspective inside view of the pair of hinged sections forming the pivotal jewelry case according to the present invention.

The present invention is directed to a foldable or pivotal jewelry case adapted to suspended or hung from a wall, where the case, in the closed position, is designed to appear as a conventional frame mounting a picture, painting or mirror. In the pivotally opened position the interior thereof provides a convenient system for storing, receiving and accessing various jewelry items, especially earrings. While a preferred embodiment includes a pair of comparably sized sections, hinged along a common edge, it is contemplated that the jewelry case may include a single rear section with plural overriding hinged sections. However, for convenience, the further description will be directed to the preferred embodiment of a pair of hinged sections, where preferred construction materials are wood and/or plastic. In the latter situation, the exposed plastic parts may be provided with a simulated wood appearance. In any case, the invention will now be described with regard to the accompanying drawings, where like reference numerals represent like components or features throughout the several views.

Figure 2:
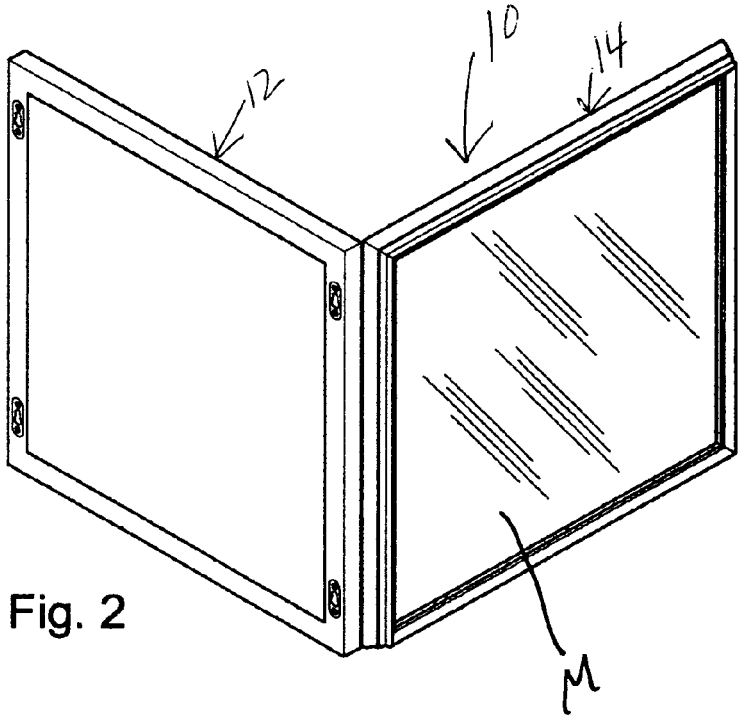
FIG. 2 is a perspective outside view of the pivotal jewelry case of FIG. 1.

FIGS. 1 and 2 illustrate two perspective views showing the preferred embodiment for the jewelry case 10 of this invention. The jewelry case 10 includes a first section 12, generally rectangular in configuration, hinged to a second section 14 by hidden hinges 16. As will apparent later, one advantage of the use of hidden hinges is that when the jewelry case 10 is closed it will appear as a conventional picture frame and not be an obvious target of a home intruder.

Figure 3:
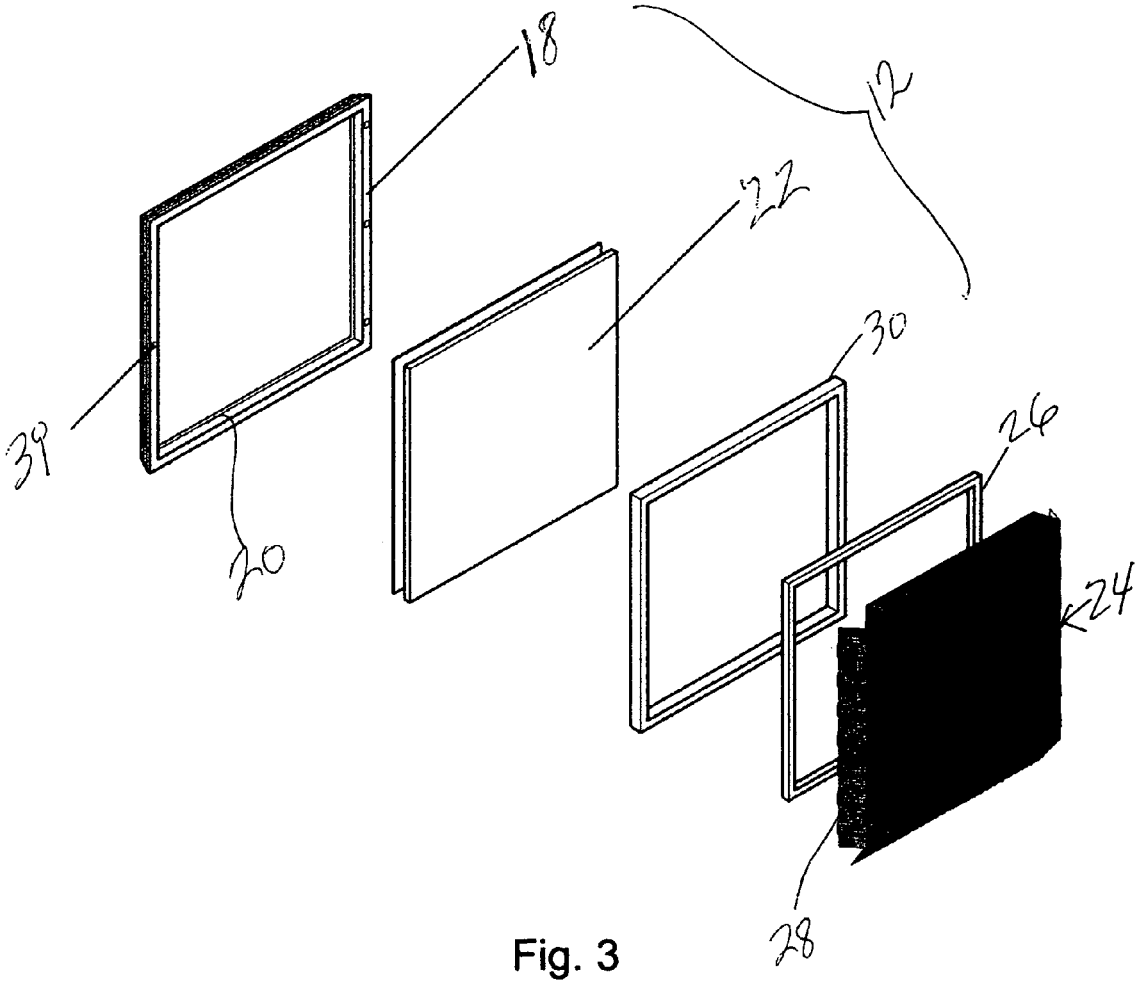
FIG. 3 is an exploded perspective view of the various components forming one of the sections of the pivotal jewelry case hereof.

FIG. 3 shows an exploded view of a first said section 12, where such section is intended to receive and store a stud-type earring, as known in the art, and other types of earrings that feature a loop to be inserted into one's pierced ear lobes. In any case, the first section 12 may comprise a first peripheral frame 18 featuring an inwardly directed continuous flange 20, providing a deep recess for receiving a planar back facing plate 22. Cooperating with said planar back facing plate 22 and deep recess are the further components of FIG. 3. Specifically, such further components include a mesh-like overlay 24, as more fully discussed with regard to FIG. 6, a first peripheral frame member 26, about which the mesh-like overlay may be secured by wrapping the edges 28 thereabout, and a second peripheral frame member 30 of a size to receive said first peripheral frame member 26, see FIG. 5. Also, the second peripheral frame member is externally sized for sliding engagement within said deep recess into contact with said planar back facing plate 22.

Figure 4:
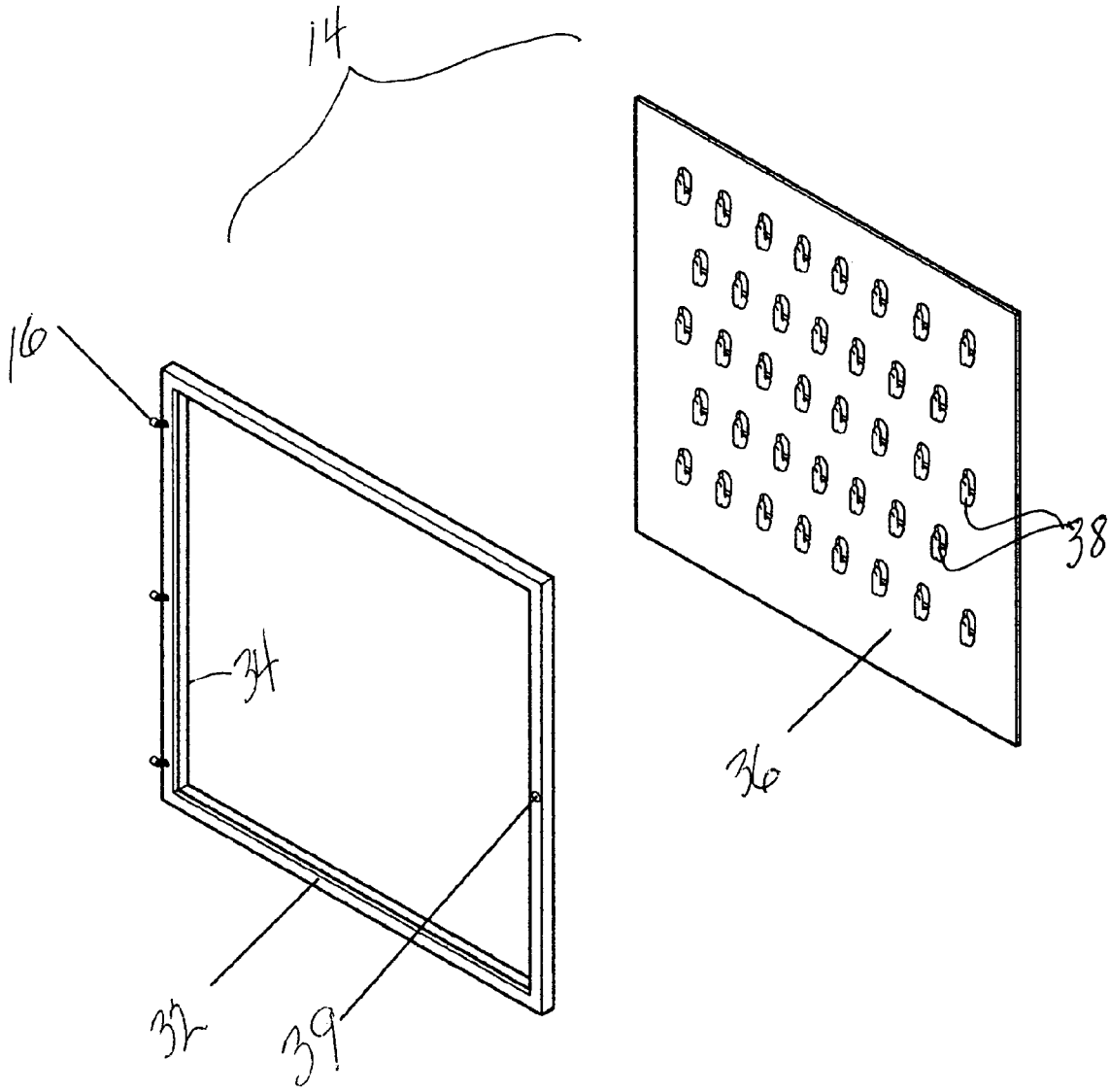
FIG. 4 is a partial, exploded perspective view of the second section hereof.

The second said section 14, as shown in exploded form in FIG. 4, may comprise a peripheral frame 32, comparable in size to the peripheral frame 18 of the first section 12, having an inwardly directed, continuous flange 34 for receiving and seating a face plate member 36. The face plate member, as shown, may include an array of hooks 38 for receiving and storing chain items, such as necklaces, bracelets, and the like. Additionally, to facilitate maintaining a closed jewelry case 10, recessed magnets 39 may be used to temporarily hold the case together.

Figure 5:
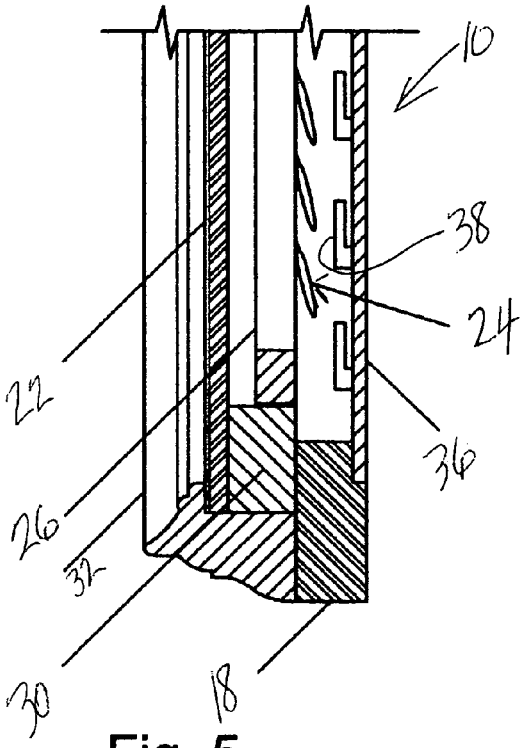
FIG. 5 is a partial, enlarged sectional view of the closed pivotal jewelry case of this invention.

FIG. 5 illustrates the folded and pivoted jewelry case 10 of this invention. The jewelry case in this closed position presents a thin profile so as to appear as a conventional frame mounting a picture, painting or mirror. Note for example in FIG. 2, where one section shows a mirror "M", but it can as well be a picture or painting. As mentioned previously, this thin profile, appearing as a conventional picture frame, can mislead an intruder into believing the jewelry case 10 is nothing more than a mirror, picture or painting.

Figure 6:
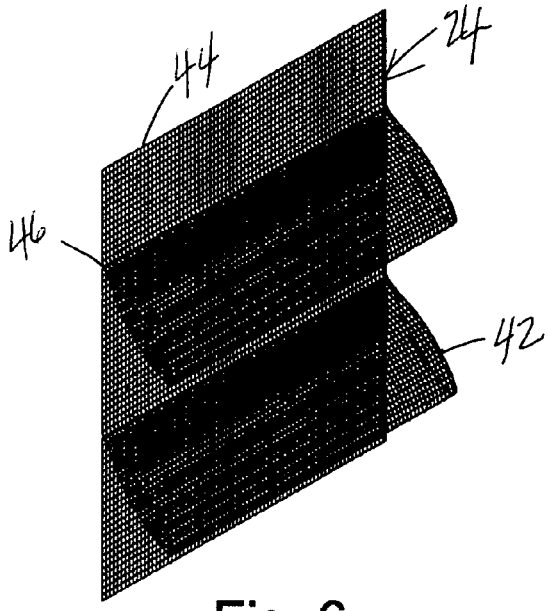
FIG. 6 is an enlarged perspective view showing a pair of angled mesh-like members for accessing and receiving pierced ear-type earrings, or hook fastening earrings, where access to the rear of the members may be necessary to secure the earrings within the jewelry case hereof.

Returning now to the mesh-like overlay 24, a portion of which is shown in FIG. 6, comprises plural, lateral mesh-like pleats 42 extending at an angle from rear face 44, where said pleats 42 are preferably two layered and sewn along an upper edge 46 to the rear face. By this arrangement, the pleats extend at an angle to the rear face so that access to the underside can be easily accomplished. Specifically, earring studs, as known in the art, comprise a decorative face or gem, i.e. diamond, within a setting, and a stud extending from the setting. For one to secure this earring to one's pierced body part, such as the ear lobe, a removable locking member is secured to the stud. The free hanging leaves allow the owner to easily and readily secure such earring thereto by merely inserting the stud through the open mesh and easily attaching the removable locking member to the stud from the underside of the leaves. Also, another type of earring to be stored here are those that feature a thin wire loop, where the loop can be easily inserted through the open mesh and suspended for later selection.

Figure 7:
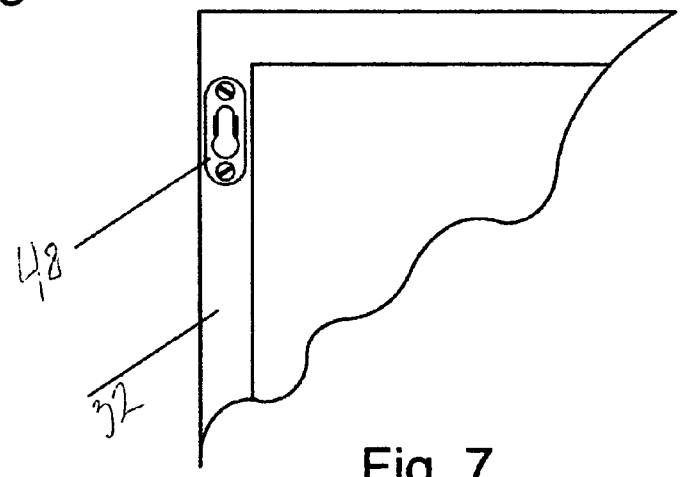
FIG. 7 is a partial plan view illustrating a mounting bracket for hanging or suspending the jewelry casse from a wall, for example.

Finally, FIG. 7, a partial plan view of the rear of one of said sections 12, 14, shows a recessed slot 48 for mounting or suspending the jewelry case to a wall, for example, where the jewelry case may include four such brackets, one at each corner, see FIG. 2.

It is recognized that changes, variations and modifications may be made to the wall suspended jewelry case of this invention, especially by those skilled in the art, without departing from the spirit and scope thereof. Accordingly, no limitation is intended to be imposed on the invention except as set forth in the accompanying claims.

I claim:

1. A wall suspendible cabinet for storing and displaying jewelry items, where said jewelry items may be slected from the group consisting of bracelets, necklaces, earrings and the like, said wall suspendible cabinet comprising:

a.) a first generally rectangular section for suspending from a wall, said first section characterized by a back face, an inside face, a peripheral frame, and a backing member secured within said peripheral frame;

b.) at least a second generally rectangular section hinged to said first section to overlap at least a portion thereof and lie contiguous thereto, said at least one said second section characterized by a front face, an inside face, a peripheral frame, and a backing member secured within said peripheral frame; and, c.) a selected said backing member containing a pleated mesh, said pleated mesh comprising a mesh face lying adjacent to said selected backing member, and a series of laterally oriented, meshed flaps having a first edge secured to said mesh face, and a second edge movable vertically to said mesh face.

2. The wall suspendible cabinet according to claim 1, wherein a different said backing member includes a plurality of hooks for suspending and displaying a variety of said jewelry items.

3. The wall suspendible cabinet according to claim 1, wherein said mesh includes plural openings of a size to readily receive an earring of the type having a looped hook, or post and lock.

4. The wall suspendible cabinat according to claim 3, wherein said pleated mesh comprises a series of laterally oriented meshed flaps.

5. The wall suspendible cabinet according to claim 1, wherein said generally rectangular sections are hinged together along a common edge of said peripheral frame, said hinges being hidden from view when said respective sections lie contiguous to one another in a storage mode.

6. The wall suspendible cabinet according to claim 1, wherein said front face of a second said section further includes a mirror.

7. The wall suspendible cabinat according to claim 1, wherein said peripheral frame of said first section includes a rear edge containing at least one wall suspending bracket.

* * * * *